US012674588B2

(12) United States Patent
Slayzak et al.

(10) Patent No.: US 12,674,588 B2
(45) Date of Patent: Jul. 7, 2026

(54) HYBRID HEATING AND COOLING SYSTEM

(71) Applicant: Seeley International Pty Ltd, Lonsdale (AU)

(72) Inventors: Steven Slayzak, Denver, CO (US); Robert William Gilbert, Adelaide (AU); Clinton Nero Leonardis, Adelaide (AU); Nathan Grant Budarick, Lonsdale (AU); James Allan Beare, Lonsdale (AU); Andrew Paul Kumnick, Lonsdale (AU); Jack Henry Arney, Lonsdale (AU)

(73) Assignee: Seeley International Pty Ltd, Lonsdale (AU)

( * ) Notice: Subject to any disclaimer, the term of this patent is extended or adjusted under 35 U.S.C. 154(b) by 129 days.

(21) Appl. No.: 18/916,517

(22) Filed: Oct. 15, 2024

(65) Prior Publication Data

US 2025/0123011 A1 Apr. 17, 2025

Related U.S. Application Data

(60) Provisional application No. 63/590,896, filed on Oct. 17, 2023.

(51) Int. Cl.
*F24F 3/06* (2006.01)
*F24F 3/00* (2006.01)
(Continued)

(52) U.S. Cl.
CPC ..... *F24F 3/065* (2013.01); *F24F 3/001* (2013.01); *F24F 3/044* (2013.01); *F24F 11/80* (2018.01)

(58) Field of Classification Search
CPC .. F24F 3/065; F24F 11/80; F24F 3/001; F24F 3/044
(Continued)

(56) References Cited

U.S. PATENT DOCUMENTS 2,759,334 A * 8/1956 Burgess ..... F24F 3/001 62/509
3,182,718 A 5/1965 Goettl
(Continued)

FOREIGN PATENT DOCUMENTS

CN 107449076 A * 12/2017 ..... F24F 5/0035
CN 214275935 U 9/2021
CN 214581535 U 11/2021

OTHER PUBLICATIONS

Cunningham, et al., Packaged Roof Top Unit with Integrated Heat Pump and Indirect/Direct Evaporative Cooling, ET21PGE1902, Emerging Technologies, Pacific Gas and Electric Company (Mar. 2022) (45 pages).
(Continued)

*Primary Examiner* — Claire E Rojohn, III
(74) *Attorney, Agent, or Firm* — Koenig IP Works, PLLC; Katherine Koenig

(57) ABSTRACT

A hybrid heating and cooling system, the system comprising an indirect-direct evaporative cooler (IDEC) subsystem; a heat pump subsystem; and a mixing plenum located between and in fluid communication with the IDEC subsystem and the heat pump subsystem, the mixing plenum being configured to mix a flow of fluid from the IDEC subsystem and a flow of fluid from the heat pump subsystem. The IDEC subsystem and the heat pump subsystem are independently operable to achieve a plurality of heating and/or cooling modes of operation.

19 Claims, 9 Drawing Sheets

(51) Int. Cl.
*F24F 3/044* (2006.01)
*F24F 11/80* (2018.01)

(58) Field of Classification Search
USPC ..... 165/201; 62/259.4
See application file for complete search history.

(56) References Cited

U.S. PATENT DOCUMENTS 4,033,740 A * 7/1977 Meckler ..... F24F 11/46 62/331
4,171,621 A * 10/1979 Trelease ..... F24F 3/001 62/201
4,300,623 A * 11/1981 Meckler ..... F24F 3/0522 165/216
4,505,327 A * 3/1985 Angle ..... F24F 3/001 62/304
4,803,849 A 2/1989 Diaz
5,325,681 A 7/1994 Ellis et al.
5,970,723 A 10/1999 Kinkel et al.
7,155,921 B2 1/2007 Lee et al.
7,441,412 B2 * 10/2008 Jensen ..... F24F 1/0007 62/305
10,921,868 B2 2/2021 Hay
10,948,223 B2 3/2021 Tolouei Asbforoushani et al.
11,532,831 B1 * 12/2022 Beh ..... C07F 17/02
11,982,471 B2 * 5/2024 Welch ..... F25B 37/00
12,188,681 B2 * 1/2025 Alhorr ..... F24F 5/0035
12,571,546 B2 * 3/2026 Meles ..... F24F 3/1417
2005/0056042 A1 * 3/2005 Bourne ..... F24F 12/006 62/310
2005/0257551 A1 * 11/2005 Landry ..... F24F 3/1429 62/271
2010/0242517 A1 * 9/2010 Johnson ..... F25B 30/06 62/260
2011/0105015 A1 * 5/2011 Carlson ..... H05K 7/20127 165/47
2014/0202449 A1 7/2014 Snyder
2015/0198353 A1 * 7/2015 Platt ..... F25D 23/006 62/298
2017/0241654 A1 * 8/2017 Lowenstein ..... F24F 3/1429
2017/0292722 A1 * 10/2017 Vandermeulen ..... F24F 3/1417
2018/0112886 A1 * 4/2018 Boody ..... F24F 11/30
2018/0156478 A1 * 6/2018 Hensley ..... F24F 3/001
2021/0352853 A1 * 11/2021 Day ..... A01G 9/246
2022/0003464 A1 * 1/2022 Sakaguchi ..... F25B 49/02
2022/0410070 A1 * 12/2022 Beh ..... B01D 61/422
2023/0003414 A1 * 1/2023 Searle ..... F24F 11/83
2023/0141446 A1 * 5/2023 Beh ..... B01D 61/50 204/263
2023/0213233 A1 * 7/2023 Ferkey ..... F24F 11/30
2023/0280049 A1 * 9/2023 Farese ..... B01D 53/263 62/271
2024/0337393 A1 * 10/2024 Farese ..... F24F 3/1417
2025/0123011 A1 * 4/2025 Slayzak ..... F24F 3/001
2025/0189161 A1 * 6/2025 Gilbert ..... F24F 11/81

OTHER PUBLICATIONS

Lyles, et al., Indirect-Direct Evaporative Rooftop Unit Field Test Final Report, Report #40363, New Buildings Institute, Northwest Energy Efficiency Alliance (Jun. 26, 2013) (37 pages).
International Search Report and Written Opinion for PCT/IB2024/060106, issued by Australian Patent Office as International Searching Authority, dated Feb. 20, 2025 (7 pages).

* cited by examiner

HYBRID HEATING AND COOLING SYSTEM

CROSS-REFERENCE TO RELATED APPLICATIONS

This application claims the benefit of the filing date of provisional U.S. Patent Application No. 63/590,896, filed Oct. 17, 2023, entitled HYBRID HEATING AND COOLING SYSTEM, the entirety of which is incorporated herein by reference.

GOVERNMENT RIGHTS STATEMENT

N/A.

TECHNICAL FIELD

This disclosure relates to a hybrid heating and cooling system, such as a hybrid packaged rooftop unit (RTU)/air handling unit for heating, ventilation, and air conditioning (HVAC) applications.

BACKGROUND

A packaged heating, ventilation, and air conditioning (HVAC) system is an integrated piece of mechanical equipment that provides all three mechanical functions for a space. Packaged roof top units (RTUs) are the predominant method of building conditioning in North and South America. Currently known RTUs include vapor compression heat pumps (i.e. electric heating and cooling) or a combination of vapor compression direct expansion (i.e. heat pump with cooling only) paired with gas heat or electric resistance heat. Some efforts have been made to develop architectures with various combinations of these systems; however, these combined systems have not been commercially viable.

SUMMARY

Some embodiments advantageously provide a hybrid heating and cooling system, such as a hybrid packaged rooftop unit (RTU)/air handling unit for heating, ventilation, and air conditioning (HVAC) applications.

In one embodiment, a hybrid heating and cooling system includes: an indirect-direct evaporative cooler (IDEC) subsystem; a heat pump subsystem; and a mixing plenum located between and in fluid communication with the IDEC subsystem and the heat pump subsystem, the mixing plenum being configured to mix a flow of fluid from the IDEC subsystem and a flow of fluid from the heat pump subsystem, the IDEC subsystem and the heat pump subsystem being independently operable.

In one aspect of the embodiment, the hybrid heating and cooling system provides between approximately 5 tons and approximately 6 tons of cooling capacity and has an installation footprint of approximately 88 inches in length, approximately 54 inches in width, and approximately 45 inches in height.

In one aspect of the embodiment, the hybrid heating and cooling system further includes a first supply fan in the mixing plenum and a second supply fan in the plenum.

In one aspect of the embodiment, the first supply fan is in fluid communication with the IDEC subsystem; and the second supply fan is in fluid communication with the heat pump subsystem.

In one aspect of the embodiment, each of the first supply fan and the second supply fan includes a backdraft damper.

In one aspect of the embodiment, each backdraft damper is a passively actuated backdraft damper.

In one aspect of the embodiment, the IDEC subsystem includes an IDEC module, the IDEC module including: at least one compact indirect evaporative cooler; and at least one direct evaporative medium.

In one aspect of the embodiment, the IDEC module further includes an exhaust fan, the at least one compact indirect evaporative cooler being a plurality of compact indirect evaporative coolers.

In one aspect of the embodiment, the plurality of compact indirect evaporative coolers are arranged radially around the exhaust fan.

In one aspect of the embodiment, the heat pump subsystem includes an evaporator subsystem and a condenser subsystem.

In one aspect of the embodiment, the system further comprising a control unit, the control unit including processing circuitry that is programmable to execute operational logic to operate the system in any of a plurality of modes of operation.

In one aspect of the embodiment, the processing circuitry is programmed to execute operational logic to selectively operate the system in a plurality of modes of operation, the plurality of modes of operation including:

- a first mode of operation in which the system provides recirculation heating, wherein the IDEC subsystem is in an off condition and the heat pump subsystem is in an on condition, return air entering the heat pump subsystem, being heated within the heat pump subsystem, and then being provided as heated supply air;
- a second mode of operation in which the system provides heating with non-recirculated air, wherein the IDEC subsystem is in an on condition and the heat pump subsystem is in an on condition, non-recirculated air entering the IDEC subsystem and then being provided as ambient supply air, and return air entering the heat pump subsystem, being heated within the heat pump subsystem, and then being provided as heated supply air;
- a third mode of operation in which the system provides passive heating and/or cooling, wherein the IDEC subsystem is in an on condition and the heat pump subsystem is in an off condition, non-recirculated air entering the IDEC subsystem and then being provided as ambient supply air;
- a fourth mode of operation in which the system provides IDEC cooling, wherein the IDEC subsystem is in an on condition and the heat pump subsystem is in an off condition, non-recirculated air entering the IDEC subsystem, being cooled within the IDEC subsystem, and then being provided as cooled supply air;
- a fifth mode of operation in which the system provides hybrid cooling, wherein the IDEC subsystem is in an on condition and the heat pump subsystem is in an on condition, non-recirculated air entering the IDEC subsystem, being cooled by the IDEC subsystem, then being supplied and cooled return air, and return air entering the heat pump subsystem, being cooled within the heat pump subsystem, and being provided as cooled supply air; and
- a sixth mode of operation in which the system provides recirculation cooling, wherein the IDEC subsystem is in an off condition and the heat pump subsystem is in an on condition, return air entering the heat pump subsystem, being cooled within the heat pump subsystem, and then being provided as cooled supply air.

In one embodiment, a method of providing heating and/or cooling to a room includes: operating a hybrid heating and cooling system in any of a plurality of modes of operation, the hybrid heating and cooling system including: an indirect-direct evaporative cooler (IDEC) subsystem; a heat pump subsystem; and a mixing plenum located between and in fluid communication with the IDEC subsystem and the heat pump subsystem, the mixing plenum being configured to mix a flow of fluid from the IDEC subsystem and a flow of fluid from the heat pump subsystem, the IDEC subsystem and the heat pump subsystem being independently operable.

In one aspect of the embodiment, operating the hybrid heating and cooling system in any of the plurality of modes of operation includes providing recirculation heating to the room by drawing return air from the room into the heat pump subsystem, heating the return air with the heat pump subsystem, and then returning the heated return air to the room as heated supply air, no air being drawn into the IDEC subsystem.

In one aspect of the embodiment, operating the hybrid heating and cooling system in any of the plurality of modes of operation includes providing heating with non-recirculated air to the room by: drawing return air from the room into the heat pump subsystem, heating the return air with the heat pump subsystem, and then returning the heated return air to the room as heated supply air; and drawing non-recirculated air into the IDEC subsystem and then providing the non-recirculated air to the room as ambient supply air, the ambient supply air from the IDEC subsystem and the heated supply air from the heat pump subsystem being mixed in the mixing plenum before being delivered to the room.

In one aspect of the embodiment, operating the hybrid heating and cooling system in any of the plurality of modes of operation includes providing passive heating and/or cooling to the room by drawing non-recirculated air into the IDEC subsystem and then providing the non-recirculated air to the room as ambient supply air, no air being drawn into the heat pump subsystem.

In one aspect of the embodiment, operating the hybrid heating and cooling system in any of the plurality of modes of operation includes providing IDEC cooling to the room by drawing non-recirculated air into the IDEC subsystem, cooling the non-recirculated air with the IDEC subsystem, and then providing the cooled non-recirculated air to the room as cooled supply air, no air being drawn into the heat pump subsystem.

In one aspect of the embodiment, operating the hybrid heating and cooling system in any of the plurality of modes of operation includes providing hybrid cooling to the room by: drawing return air from the room into the heat pump subsystem, cooling the return air with the heat pump subsystem, and then returning the cooled return air to the room as cooled supply air; and drawing non-recirculated air into the IDEC subsystem, cooling the non-recirculated air with the IDEC subsystem, and then providing the cooled non-recirculated air to the room as cooled supply air, the cooled supply air from the IDEC subsystem and the cooled supply air from the heat pump subsystem being mixed in the mixing plenum before being delivered to the room.

In one aspect of the embodiment, operating the hybrid heating and cooling system in any of the plurality of modes of operation includes providing recirculation cooling to the room by drawing return air into the heat pump subsystem, cooling the return air with the heat pump subsystem, and then returning the cooled return air to the room as cooled supply air, no air being drawn into the IDEC subsystem.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

Figure 1:
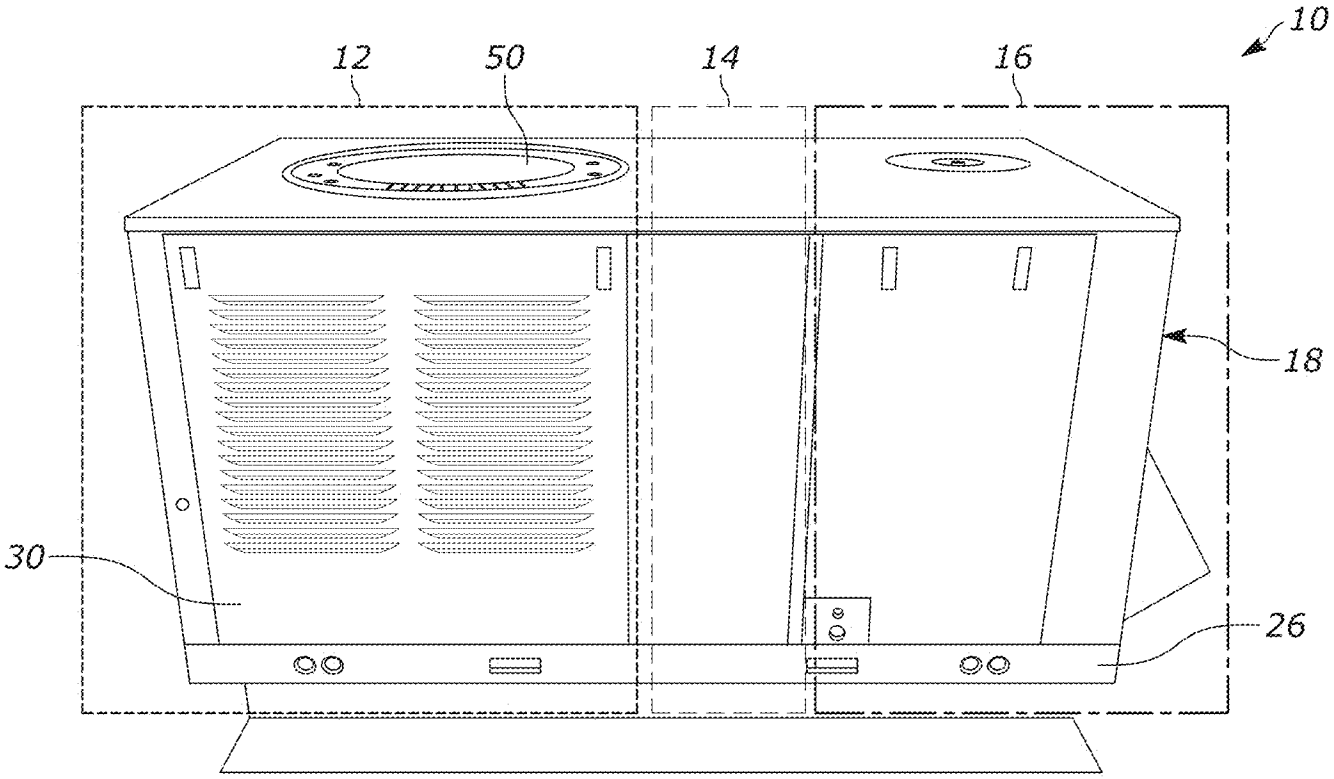
FIG. 1 shows a perspective view of a hybrid heating and cooling system, in accordance with the present disclosure.

Before describing in detail exemplary embodiments, it is noted that the embodiments reside primarily in combinations of apparatus components and steps related to a hybrid heating and cooling system and movement of air therethrough. Accordingly, the system and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

Disclosed herein is a hybrid heating and cooling system (also referred to herein as a "hybrid system"). In one embodiment, the hybrid system is a hybrid packaged rooftop unit (RTU)/air handling unit for heating, ventilation, and air conditioning (HVAC) applications. The hybrid system provides enhanced ventilation and outside air rates, as well as fully electrified and automated cooling (sensible and latent) and heating functions without the need for fossil fuel. In one embodiment, the hybrid system is a packaged HVAC system that is an integrated piece of mechanical equipment that provides all three functions for a space. In one embodiment, the hybrid system generally includes a heat pump with an indirect-direct evaporative cooling (IDEC) system that is designed as a direct replacement for a traditional packaged roof top unit. The hybrid system improves indoor air quality and delivers thermal comfort with enhanced efficiency by gaining climate specific energy advantages to maximize coefficient of performance.

In one embodiment, the hybrid system is structured with mechanical components and subsystems organized as shown and described herein. The layout is unique to the application and the organization of components is based on the standardized 5-10 ton roof curb designs (mounting frames). In some embodiments, the hybrid system is composed and arranged such that it can replace, or fit the footprint of, a standardized 5-ton system. For instance, in the relevant field, a system that can remove 12,000 British thermal units (BTUs) of heat from a space is considered to be a 1-ton system. Likewise, a 10-ton system removes 120,000 BTUs per hour when it runs. In some embodiments, the hybrid system is capable of replacing a 5-ton or 6-ton system, while occupying a minimal footprint. In some embodiments, the hybrid system occupies a footprint of approximately 88 inches in length (±2.0 inches), approximately 54 inches in width (±2.0 inches), and approximately 45 inches in height (±2.0 inches). In one non-limiting example, the hybrid system occupies a footprint of 88.6 inches in length, 54.1 inches in width, and 45.2 inches in height. In some embodiments, the hybrid system is usable as a drop-in replacement for existing packaged RTUs. In some embodiments, the hybrid system provides the same nominal cooling capacity as a standard-sized RTU. Thus, the hybrid system achieves maximum output and operational variability in a very small package. In one embodiment, the supply air and return air duct locations in the standardized systems set the positions of the supply air and return air plenums, respectively, of the hybrid system. In some embodiments, the components of the hybrid system may be packable within a standard shipping container for efficient transport and delivery. In some embodiments, the hybrid system is compatible with (but not limited to) standard 5- to 10-ton roof curbs.

In one embodiment, the components of the hybrid system are arranged such that energy flows between complementary subsystems to provide mutualistic climate-specific energy advantages, which substantially improves performance over known systems. In one embodiment, the architecture of the hybrid system enables a significant increase in outside air rates with no performance penalty relative to vapor compression cycle performance. The hybrid system is also suitable for a wider range of applications (for example, it can provide make-up air in addition to regular comfort cooling). Further, in one embodiment, the hybrid system meets physical requirements of a standard installation. For example, its overall footprint is as compact, or is more compact, in overall size than a regular 5-ton single (or dual technology) packaged rooftop unit or air handler, and its base floor and/or air supply/return plenum registers match the format of a standard 5-ton roof curb (building interference).

In one embodiment, each subsystem of the hybrid system is configured to operate an in integrated manner with the other subsystems, or independently of the other subsystems without compromise. This is possible because the architecture of the hybrid system includes a mixing chamber (mixing plenum) that includes at least one supply fan with backdraft prevention device(s). Still further, performance of each subsystem is proportional to the speed of fans attached to each separate subsystem. In one embodiment, control is determined by a controller module based on received external signals such as room temperature, room relative humidity, outside temperature, outside relative humidity, and/or other conditions. In one embodiment, the controller module solves an optimization problem and provides instructions to each subsystem, such that the hybrid system produces maximum capacity output with the least amount of electrical energy consumption.

In some embodiments, the energy flow between the subsystems of the hybrid system is organized in a manner that provides energy advantages in a variety of climates. For example, the indirect evaporative subsystem may be operated in dry periods where it provides sensible cooling with a high coefficient of performance (COP) and most often coincides with peak electrical demand. If outdoor humidity increases, then dehumidification or second stage cooling may be required. This latent cooling may be provided by the direct expansion heat pump system.

Figure 2:
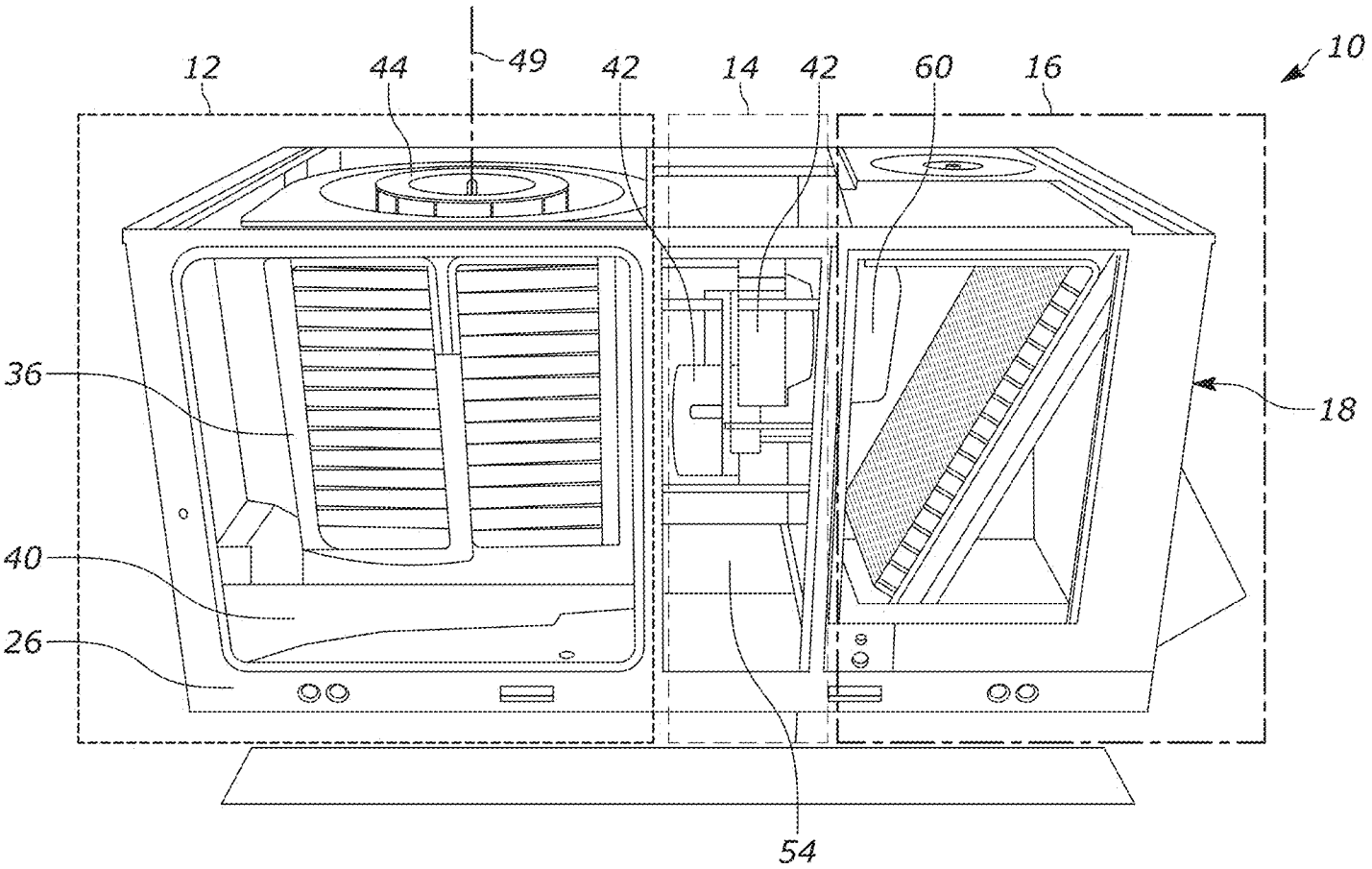
FIG. 2 shows a perspective view of the hybrid heating and cooling system of FIG. 1, with housing panels removed to show interior components, in accordance with the present disclosure.
Figure 3:
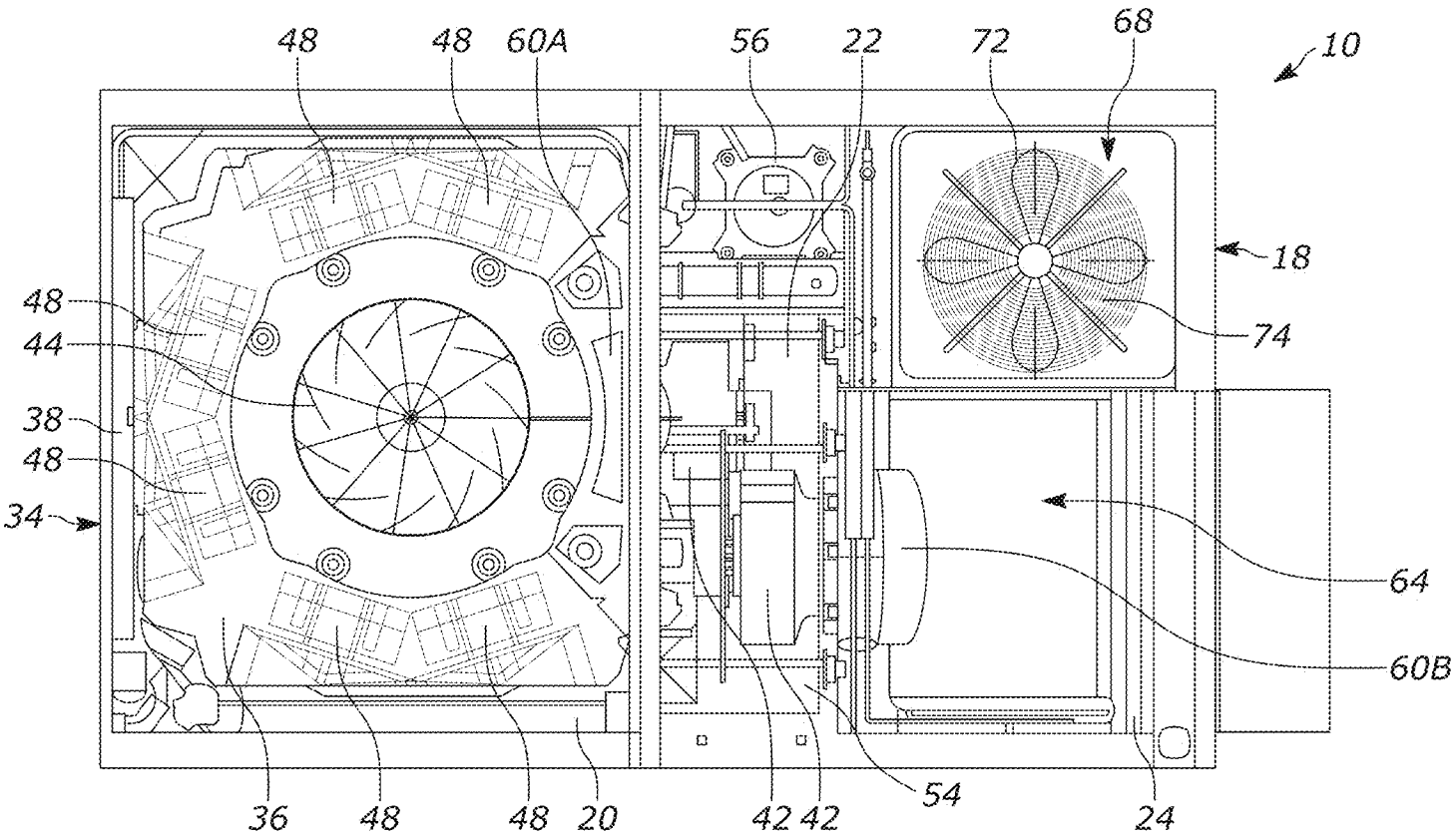
FIG. 3 shows a top view of the hybrid heating and cooling system of FIG. 1, with housing panels removed to show interior components, in accordance with the present disclosure.
Figure 4:
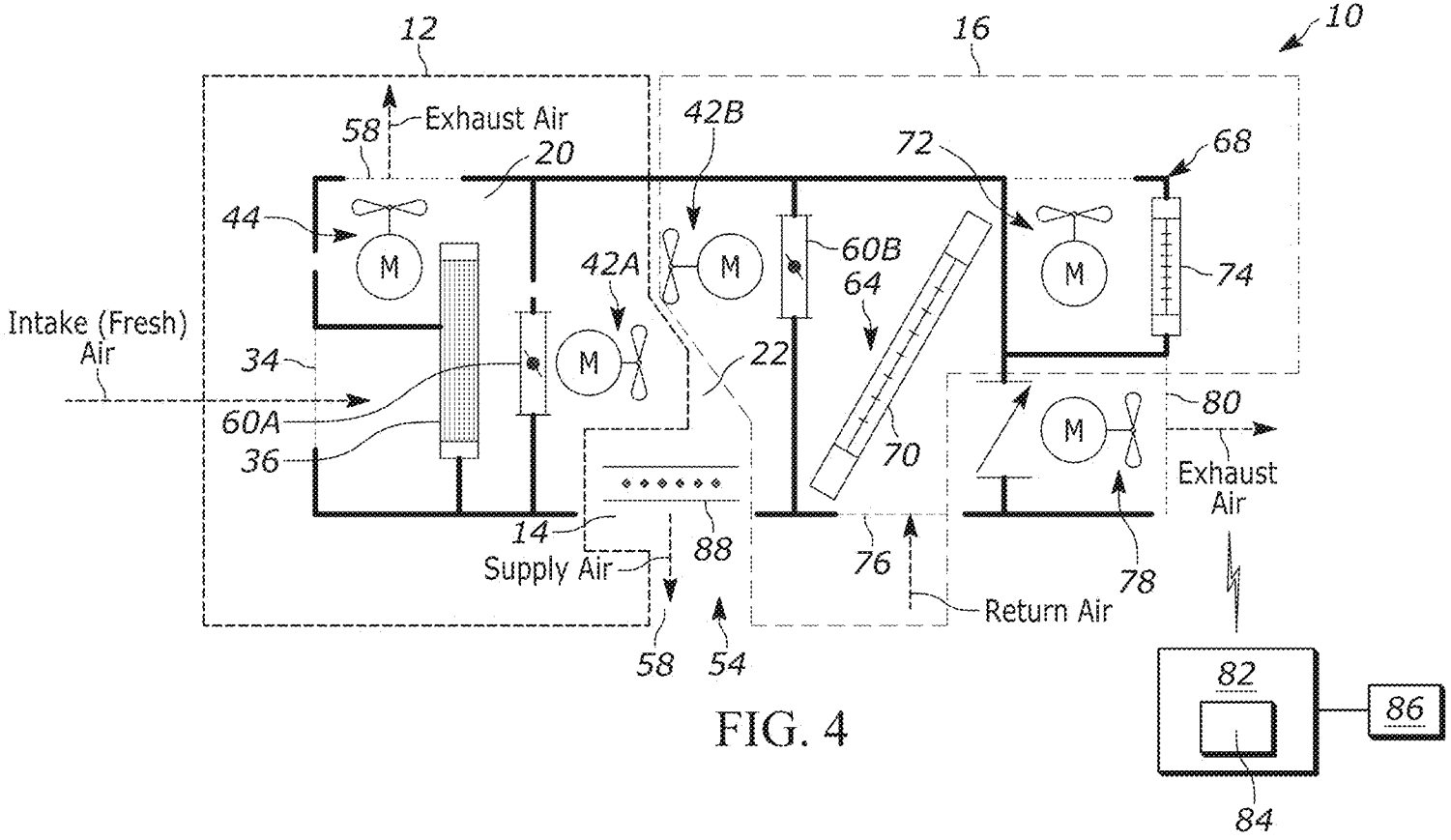
FIG. 4 shows a schematic view of a hybrid heating and cooling system, in accordance with the present disclosure.
Figure 5A:
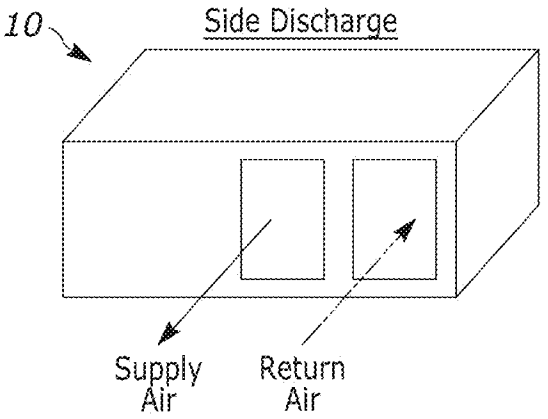
FIG. 5A, FIG. 5B, FIG. 5C, and FIG. 5D each show an exemplary configuration of a supply air flow path and a return air flow path.
Figure 5B:
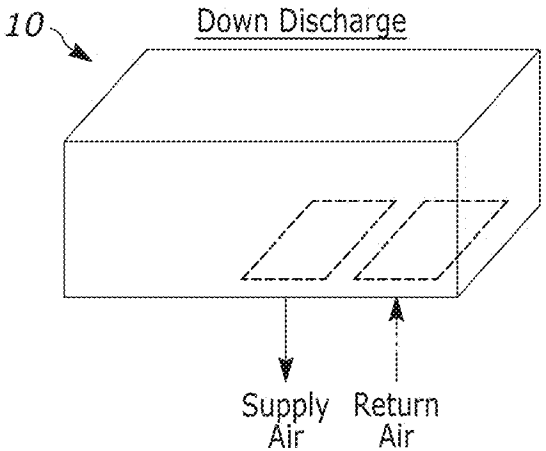
Figure 5C:
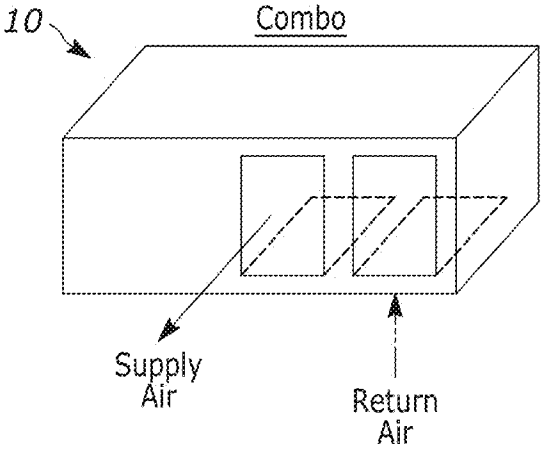
Figure 5D:
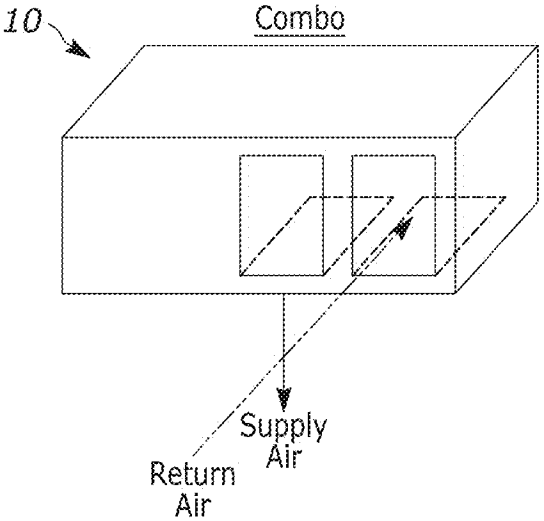

Referring now to the figures in which like reference designators are used for like elements, a hybrid heating and cooling system (hybrid system) 10 is shown in FIGS. 1-4. FIG. 1 shows a perspective view of the hybrid system; FIG. 2 shows a perspective view of the hybrid system with housing panels removed to show interior components; FIG. 3 shows a top view of the hybrid system with housing panels removed to show interior components; and FIG. 4 shows a schematic view of the hybrid system. In one embodiment, the hybrid system 10 generally includes three zones: an indirect-direct evaporative cooling (IDEC) subsystem 12, a mixing plenum subsystem 14, and a heat pump subsystem 16. The hybrid system 10 provides the energy efficiency of evaporative cooling via the IDEC subsystem 12 and the additional utility of the heat pump subsystem 16. These three zones are delineated in FIGS. 1 and 2 with broken lines. In one embodiment, the hybrid system 10 includes a housing 18 that defines a first chamber 20 that at least partially corresponds to the IDEC subsystem 12, a second chamber 22 that at least partially corresponds to the mixing plenum subsystem 14, and a third chamber 24 that at least partially corresponds to the heat pump subsystem 16 (for example, as shown in FIG. 3). The housing 18 may include a chassis 26 including a floor, a plurality of housing panels 30, and/or other components to house the components of the hybrid system 10, to provide aesthetic appeal, to protect the components of the hybrid system from the elements, to suit a particular installation location, and/or for other purposes.

Continuing to refer to FIGS. 2-4, the internal components of the hybrid system 10 are shown. In one embodiment, the IDEC subsystem 12 is located on the lefthand side of the hybrid system 10 (for example, as viewed from the perspective shown in FIGS. 1-4) because it does not require a return air stream. In one embodiment, the IDEC subsystem 12 generally includes an inlet 34, an IDEC module 36, at least one filter 38, a water management and distribution system including a water management reservoir 40, at least one supply fan 42, and an exhaust fan 44. In some embodiments, the supply fan 42 and/or the exhaust fan 44 (and/or any other fans of the hybrid system 10) are variable-speed fans. In one embodiment, the IDEC module 36 is above and proximate the water management reservoir 40 and the water management reservoir 40 rests on the floor of the chassis 26 when the hybrid system 10 is assembled.

In some embodiments, the IDEC module 36 is manufactured as a single unitary piece with the water management reservoir 40. In other embodiments, they are separate components that are connected and/or arranged during assembly of the hybrid system 10. In one embodiment, the IDEC module 36 defines a chamber and the exhaust fan 44 is mounted within the chamber. In one embodiment, the IDEC module 36 includes at least one compact indirect evaporative cooler 48 and at least one direct evaporative medium. In one embodiment, the at least one filter 38 is positioned between the inlet 34 and the IDEC module 36 and/or within a housing of the IDEC module 36 and upstream of the at least one compact indirect evaporative cooler 48. In one embodiment, the inlet 34 is at least partially defined by the housing 18 (such as by the chassis 26 and/or one or more of the plurality of housing panels 30) In one embodiment, the IDEC module 36 includes a plurality of compact indirect evaporative coolers 48 that are arranged radially around the axial axis of the IDEC module 36 (the axis 49 about which the exhaust fan 44 rotates), such as shown in FIG. 2. The at least one compact indirect evaporative cooler 48 is referred to herein as the "compact indirect heat exchanger" for simplicity. In one non-limiting example, the IDEC module 36 includes six compact indirect evaporative coolers 48. In one embodiment, each compact indirect evaporative cooler 48 is as described in International Pub. No. WO2016037232A1, U.S. Pat. No. 8,783,054B2, U.S. Pat. No. 10,151,497B2, and/or US Pub. No. 2018/0231262A1, the entirety of each of which being incorporated herein by reference. For example, in one non-limiting embodiment, each compact indirect evaporative cooler 48 includes heat exchanger core having heat at least one exchange substrate defining a plurality of wet air flow passages and a plurality of dry air flow passages, such as a continuous sheet of hydrophobic material with flocking on at least a portion of at least one side of the sheet (for form wettable surfaces) and air flow guiding structures on at least one of the first side and the second side of the sheet; fold lines may be defined in the sheet defining plates extending between adjacent fold lines and slits may be formed along the fold lines; accordion pleating may form alternating wet and dry passages between the plates with the wet passages formed between opposing wettable surfaces, the dry passages formed between non-flocked surfaces, the accordion pleating causing the slits in the folds to open and form air inlets and outlets in communication with the air flow passages. Additionally or alternatively, each compact indirect evaporative cooler 48 may be configured as disclosed in these references incorporated herein by reference.

In one embodiment, the water management and distribution system of the IDEC module 36 includes various components for the supply, movement, and/or removal of water throughout the IDEC module 36, including but not limited to at least one solenoid valve, a supply water reservoir, a network of fluid conduits, at least one water pump, a water level probe, a drain valve, and/or a chlorinator (for bacteria control and water treatment). In one embodiment, a water supply (for example, a water supply located external to the hybrid system) is fluidly connected directly to the solenoid valve. In one embodiment, the solenoid valve is automatically or semi-automatically actuated to fill the supply water reservoir with water from the water supply ("supply water"), then the solenoid valve is automatically or semi-automatically actuated to distribute the supply water to each of the at least one compact indirect evaporative coolers through the network of fluid conduits fed by the at least one water pump. In one embodiment, the IDEC module 36 includes a first water pump and a second water pump. In this embodiment, the first water pump provides supply water to each heat exchange of the at least one compact indirect evaporative cooler 48 and the second water pump provides supply water to the at least one direct evaporative medium. In one embodiment, the IDEC module 36 includes a plurality of direct evaporative media.

In one embodiment, the IDEC subsystem 12 further includes an exhaust fan 44 and an outlet 50 to release exhaust air. In one embodiment, the exhaust fan 44 is located within or proximate the outlet 50, and the exhaust air is expelled into the environment surrounding the hybrid system 10 by the exhaust fan 44. In one embodiment, the IDEC subsystem 12 further includes a water management system. In one embodiment, the water management system includes a microprocessor, as well as at least one sensor and at least one valve (such as one or more electric valves) that are in wired and/or wireless communication with the microprocessor. In one embodiment, the at least one sensor includes at least one sensor configured to measure salt and/or chlorine levels of water flowing within the IDEC subsystem 12 (for example, salinity may be approximated in microSiemens by measuring total dissolved solids). In one embodiment, the microprocessor is programmed or programmable to receive measurement data from the at least one sensor, such as salinity and/or chlorination measurement data, to continuously monitor and replenish water within the system, thereby preserving water quality and reducing water consumption. In one embodiment, the microprocessor replenishes water within the IDEC subsystem 12 but automatically or semi-automatically activating the at least one valve and/or solenoid to drain the supply water reservoir. In some embodiments, the IDEC subsystem 12 further includes one or more additional components, such as filter(s), conduits, control systems, and/or others.

In one embodiment, the hybrid system 10 combines the energy-saving benefits of indirect-direct evaporative cooling with the capabilities of a heat pump. In one embodiment, the IDEC subsystem 12 operates solely with outdoor air (that is, air in an environment external to the hybrid system) filtered by the at least one filter 38 (for example, at least one cartridge filter) on the inlet 34. The IDEC subsystem 12 operates using both indirect and direct cooling in series by passing the air through an indirect evaporative heat exchanger followed by direct evaporative media within each of the at least one compact indirect evaporative cooler 48. The resulting supply air is below the wet bulb temperature of the ambient air, meaning that comfort can be maintained in buildings in dry climates like California using significantly less electricity than compressor-based air conditioners.

In one embodiment, the IDEC subsystem 12 is operable on its own at part load to provide superior coefficients of performance. For example, currently known indirect-direct evaporative coolers with equal capacity to the IDEC subsystem 12 of the hybrid system 10 disclosed herein achieve a peak coefficient of performance of around 4 (SEER18), whereas the IDEC subsystem 12 is capable of achieving coefficients of performance of 7 or more (SEER35+). Further, at part load, the coefficient of performance of the IDEC subsystem 12 of the hybrid system 10 can increase to between 12-15. That is, the IDEC performance is superior to that of a heat pump under favorable conditions.

Continuing to refer to FIGS. 2-4, in one embodiment the mixing plenum subsystem 14 includes a mixing plenum 54 that is generally defined, at least partially, by the second chamber 22 of the housing 18 of the hybrid system 10. However, in some embodiments the second chamber 22 may also include one or more components of the IDEC subsystem 12, such as a supply fan 42, and one or more components of the heat pump subsystem 16, such as a supply fan 42 and/or a compressor subsystem 56. In other embodiments, the at least one supply fan 42 is a part of the mixing plenum subsystem 14. For example, in one embodiment, the mixing plenum subsystem 14 includes a first supply fan 42A that is in fluid communication with the IDEC subsystem 12 and a second supply fan 42B that is in fluid communication with the heat pump subsystem 16, with both supply fans 42A, 42B being in fluid communication with the mixing plenum 54. Consequently, the mixing plenum 54 may function as a mixing chamber for supply air from the IDEC subsystem 12 and the heat pump subsystem 16. The mixing plenum 54 includes an outlet 58 that is in fluid communication with a space to be cooled or heated (for example, a room and/or ductwork in a building) and from which supply air is delivered. In one embodiment, each supply fan 42 includes and/or is coupled to a backdraft damper 60, with each backdraft damper 60 extending between its associated supply fan 42 and the chamber of the subsystem from which its associated supply fan 42 receives air. In some embodiments, each backdraft damper 60 is a passive backdraft damper. For example, in one embodiment a first backdraft damper 60A includes an inlet that is in fluid communication with the first chamber 20 (wherein the IDEC subsystem 12 is located) and/or IDEC module 36 and an outlet that is coupled to and in fluid communication with the first supply fan 42A and, thereby, the second chamber 22 (mixing plenum 54). For example, in one embodiment, a second backdraft damper 60B includes an inlet that is in fluid communication with the third chamber 24 (wherein the heat pump subsystem 16 is located) and an outlet that is coupled to and in fluid communication with the second supply fan 42B and, thereby, the second chamber 22 (mixing plenum 54). In some embodiments, the backdraft damper(s) 60 are configured to prevent the entry of outside air into the mixing plenum 54. Further, in some embodiments the heat pump subsystem supply fan, such as the second supply fan 42B, positively pressurizes the mixing plenum 54 to prevent, in combination with the backdraft damper(s) 60 (and other components, such as filters), the entry of environmental contaminants (for example, wildfire smoke, carbon dioxide, volatile organic compounds, ozone, odors, and/or microbial agents) from leaching into a building via the hybrid system 10.

As is discussed in greater detail below, the supply fans 42 are independently operable; consequently, the IDEC subsystem 12 and the heat pump subsystem 16 may be decoupled from each other (that is, may be operated individually) so the hybrid system can be operated in any of a variety of modes of operation. Further, redundancy is provided in embodiments wherein the mixing plenum subsystem 14 includes more than one supply fan 42, such that one subsystem (IDEC subsystem or heat pump subsystem) fails, the other can continue to operate. Additional benefits are that each subsystem may be optimized separately, without incurring an opportunity cost or trade-off, and that the system components are operable in parallel rather than in series. The configuration of the hybrid system 10 provides a greater degree of operational mode flexibility, and control of the hybrid system 10, such as by a control unit, is equally flexible and can perform, or provide instructions to perform, more complex functions than in currently known systems. Additionally, there is no performance penalty to either the IDEC subsystem 12 or the heat pump subsystem 16, as they are capable of remaining in their optimal performance ranges.

Continuing to refer to FIGS. 2-4, in one embodiment the heat pump subsystem 16 generally includes an evaporator subsystem 64 and a condenser subsystem 68. In one embodiment, the evaporator subsystem 64 is canted within the third chamber 24 (for example, as shown in FIG. 2). In one embodiment, the evaporator subsystem 64 includes an evaporator coil 70 within which a refrigerant is vaporized. In one embodiment, the condenser subsystem 68 is in fluid communication with the evaporator subsystem 64 and includes a condenser fan 72 and a condenser coil 74. In one embodiment, the heat pump subsystem 16 further includes a flow control subsystem, a compressor subsystem 56, and a reversing valve. As is shown, for example, in FIG. 3, in some embodiments at least a portion of the compressor subsystem may be located within the second chamber 22. In some embodiments, the flow control subsystem, the compressor subsystem 56, and the reversing valve are each in fluid communication with the evaporator subsystem 64 and the condenser subsystem 68 for the recompression of the heat pump subsystem refrigerant and circulation of the refrigerant throughout the heat pump subsystem 16. In one embodiment, the reversing valve is operable to reverse the flow of refrigerant to enable the heat pump subsystem 16 to produce cooling or heating. However, in some embodiments the heat pump subsystem 16 includes a normal (non-reversing) valve in applications wherein only cooling is needed.

In one embodiment, the heat pump subsystem 16 further includes an inlet 76. In one embodiment, the inlet may be at least partially defined by the housing 18 (for example, the chassis and/or one or more housing panels). Supply air enters the heat pump subsystem 16 through the inlet 76 as return air, such as from a room being cooled or heated by the hybrid system 10.

Figure 6:
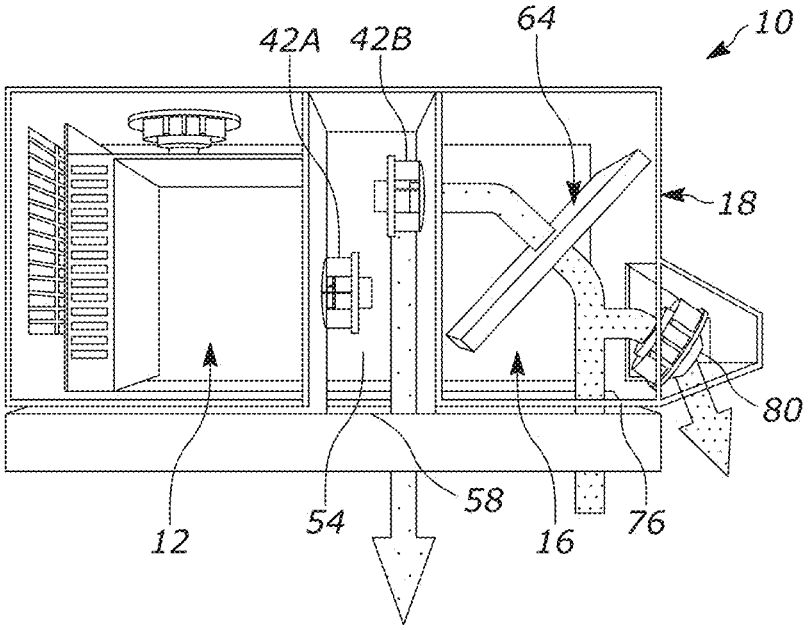
FIG. 6 shows a simplified side view of a hybrid heating and cooling system in an exemplary first mode of operation, with airflow indicated by arrows, in accordance with the present disclosure.
Figure 9:
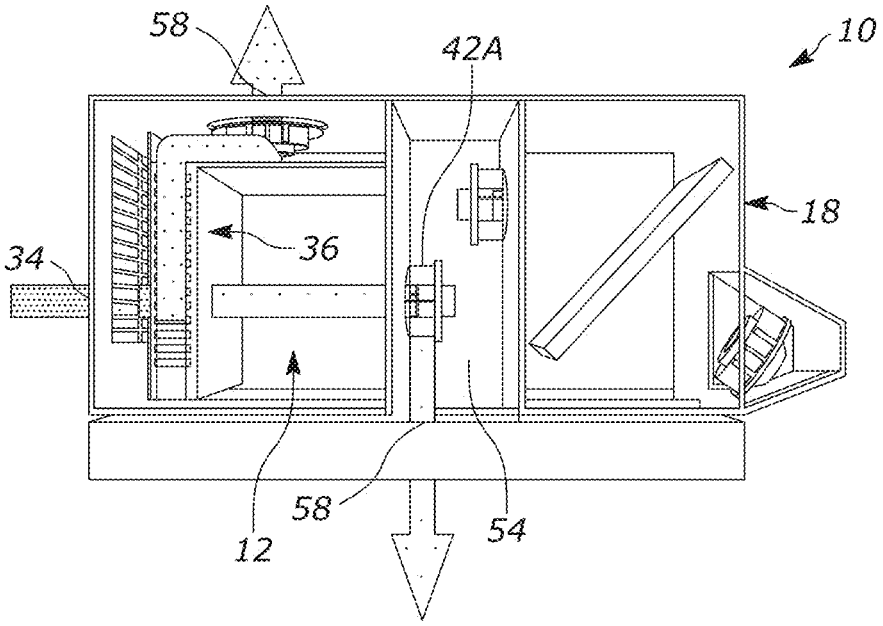
FIG. 9 shows a simplified side view of a hybrid heating and cooling system in an exemplary fourth mode of operation, with airflow indicated by arrows, in accordance with the present disclosure.

In one embodiment, the heat pump subsystem 16 further includes an exhaust fan 78 and an outlet 80 to release exhaust air. In one embodiment, the exhaust fan 78 is located within or proximate the outlet 80, and the exhaust air is expelled into the environment surrounding the hybrid system 10 by the exhaust fan 78 (for example, as shown in FIGS. 5, 6, and 9). In some embodiments, the heat pump subsystem 16 further includes one or more additional components, such as filter(s), conduits, control systems, and/or others.

In some embodiments, the hybrid system 10 further includes a control unit 82 and associated circuitry that is programmed or programmable to effectuate one or more modes of operation (operating routines), such as those shown and described in FIGS. 5-10. In one embodiment, the control unit 82 includes processing circuitry 84 having a processor and a memory. The memory is in electrical communication with the processor and has instructions that, when executed by the processor, configure the processor to effectuate one or more modes of operation of the hybrid system 10. In some embodiments, the control unit 82 supports networked building management system (BMS) interfaces and/or various communication protocols such as Modbus (RTU, TCP/IP) and/or BACnet (MSTP, IP). In some embodiments, discrete electromechanical control is possible via dedicated low voltage plug receptacles fitted inside the electrical cabinet of the hybrid system 10. In one embodiment, the control unit 82 includes a user interface device 86, such as one or more screens, touchscreens, buttons, knobs, actuators, or the like that are engageable by a user for the manual and/or semi-automatic control of the control unit and hybrid system 10 (and/or to establish an automatic operation of the hybrid system 10). In one embodiment, the control unit 82 is in wired and/or wireless communication with one or more external modules, including but not limited to cloud database(s), remote computer(s), user interface(s), data storage module(s), communications system(s), sensor(s), alert/alarm system(s), and/or others.

In some embodiments, the hybrid system 10 may include one or more additional subsystems, including but not limited to energy recovery ventilation (ERV), heat recovery ventilation (HRV), boost electric resistance heating, and evaporative condensing.

Referring now to FIGS. 5A-5D, exemplary configurations of a supply air flow path and a return air flow path are shown. As shown in the non-limiting example of FIG. 5A, in one embodiment, each of the supply air flow path and the return air flow path are positioned in a side-discharge orientation. As shown in the non-limiting example of FIG. 5B, in one embodiment, each of the supply air flow path and the return air flow path are positioned in a downward-discharge orientation. As shown in the non-limiting example of FIG. 5C, in one embodiment, the supply air flow path is positioned in a side-discharge orientation and the return air flow path is positioned in a downward-discharge orientation. As shown in the non-limiting example of FIG. 5D, in one embodiment, the supply air flow path is positioned in a downward-discharge orientation and the return air flow path is positioned in a side-discharge orientation. For example, in a downward-discharge orientation, the hybrid system 10 is positioned above a space to be cooled and the supply and return air is directed in a vertical, or at least substantially vertical, direction. However, it will be understood that the hybrid system 10 may be positioned at any location relative to the space to be cooled, and the ductwork connecting the hybrid system 10 and the space to be cooled may be appropriately configured to accommodate the air flow direction of the supply air flow path and the return air flow path.

Referring now to FIGS. 6-11, various modes of operation of the hybrid system 10 are shown. Airflow direction is represented with arrows in these figures. In some embodiments, operational logic of the hybrid system 10 is controlled or executed by the control unit 82. That is, the control unit 82 may automatically or semi-automatically, be programmed and/or programmable to, and/or may be manually operated by a user to, transition the hybrid system 10 between one or more modes of operation. One or more modes of operation may be selected by a user to control the amount and/or configuration of heating and/or cooling provided by the hybrid system 10. Although six modes of operation are shown, it will be understood that additional modes of operation may be available.

A first exemplary mode of operation is shown in FIG. 6, wherein the hybrid system 10 provides recirculation heating. In this mode of operation, the heat pump subsystem 16 recirculates air with compressor-based heating. In some embodiments, heating is provided by the heat pump subsystem 16 using the compressor subsystem 56 with no fresh air (that is, outside air from the environment surrounding the hybrid system, or air that has not been directly recirculated from the room) entering the IDEC subsystem 12 and supplied as supply air. That is, the heat pump subsystem 16 is in an "on" condition (for example, being controlled by the control unit 82 and operating to provide heating and/or cooling) to operate independently and alone, with the IDEC subsystem 12 being in an "off" condition (that is, being shut off or in stand-by mode and not operating to provide heating and/or cooling). Return air enters the heat pump subsystem 16 from a room or space being heated by the hybrid system 10 (referred to as a "room" for simplicity), such as through the inlet 76 of the heat pump subsystem 16. The return air is heated by the heat pump subsystem 16 and provided back to the room as supply air. Thus, air within the room is heated and recirculated by the heat pump subsystem 16. A portion of the return air may be vented to the environment, such as through the outlet 80, as exhaust air. In some embodiments, the second supply fan 42B, the condenser fan 72, the exhaust fan 78, and the compressor subsystem 56 are activated and the second backdraft damper 60B is open. In some embodiments, the first backdraft damper 60A is closed. Boost heat capacity is available if an auxiliary electric heater is fitted to the system.

Figure 7:
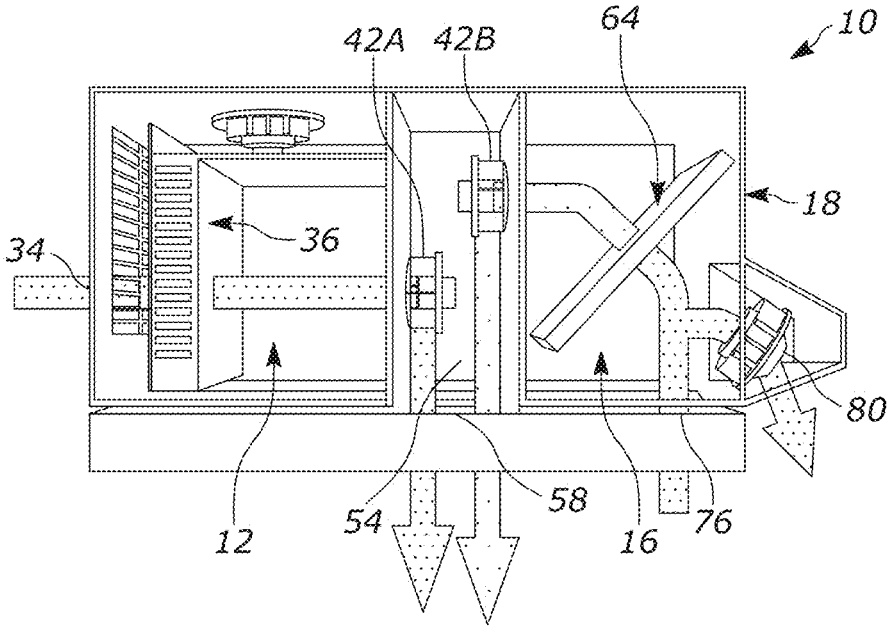
FIG. 7 shows a simplified side view of a hybrid heating and cooling system in an exemplary second mode of operation, with airflow indicated by arrows, in accordance with the present disclosure.

A second exemplary mode of operation is shown in FIG. 7, wherein the hybrid system 10 provides heating with fresh (outside, or non-recirculated) air. In this mode of operation, the heat pump subsystem 16 recirculates air with compressor-based heating. In some embodiments, heating is provided by the heat pump subsystem 16 as shown and described in FIG. 6. Additionally, in this mode of operation the IDEC subsystem 12 is also in the "on" condition so both the IDEC subsystem 12 and the heat pump subsystem 16 operate in parallel to provide a mixture of fresh air and recirculated air to the room. Fresh air enters the IDEC subsystem 12 from the environment surrounding the hybrid system, such as through the inlet 34, but is not cooled by the IDEC subsystem 12. Ambient air from the IDEC subsystem 12 and heated air from the heat pump subsystem 16 are mixed within the mixing plenum 54 and together supplied to the room. In this mode of operation, the high stage of the compressor subsystem 56 is used. For example, in one embodiment the compressor subsystem 56 includes a compressor that is a two-speed compressor, and it is used at 100% capacity (second speed) in this mode of operation. In some embodiments, the second mode of operation is modified wherein an electric resistance heater 88 warms up the mixed supply air from the IDEC subsystem 12 and heat pump subsystem 16. This may be used when the outside air is cold. Thus, in one embodiment an electric resistance heater 88 (for example, as shown in FIG. 4) may be used to "boost" the mixed air to an acceptable temperature. In some embodiments, the first supply fan 42A and the exhaust fan 44 are activated, and the first backdraft damper 60A is open. Further, in some embodiments, the second supply fan 42B, the condenser fan 72, and the compressor subsystem 56 are activated, and the second backdraft damper 60B is open. Boost heat capacity is available if an auxiliary electric heater is fitted to the system.

Figure 8:
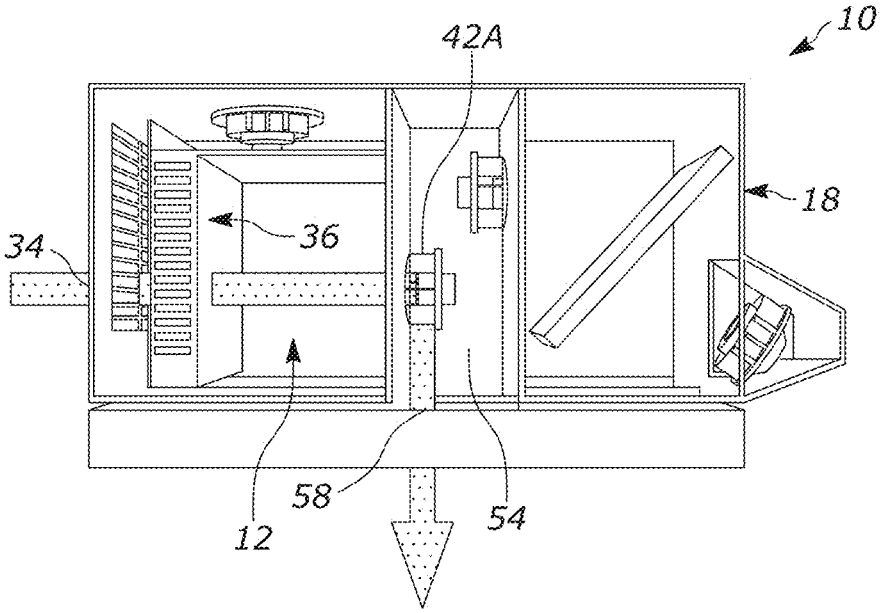
FIG. 8 shows a simplified side view of a hybrid heating and cooling system in an exemplary third mode of operation, with airflow indicated by arrows, in accordance with the present disclosure.

A third exemplary mode of operation is shown in FIG. 8, wherein the hybrid system 10 provides passive heating and/or cooling. In this mode of operation, passive heating and/or cooling is provided by the IDEC subsystem 12 using the compressor subsystem 56 with no return air entering the heat pump subsystem 16 and being supplied as ambient supply air. That is, the IDEC subsystem 12 is in an "on" condition to operate independently and alone, with the heat pump subsystem 16 being in an "off" condition. Fresh air enters the IDEC subsystem 12, such as through the inlet 34, from the environment surrounding the hybrid system 10. In one embodiment, no air exits the IDEC subsystem 12 as exhaust air. In some embodiments, the first supply fan 42A and the exhaust fan 44 are activated, and the first backdraft damper 60A is open. In some embodiments, the exhaust fan is active only to prevent outdoor filter bypass. In some embodiments, in this mode of operation the hybrid system 10 is "economizing," wherein the fresh air entering the IDEC subsystem 12 is not being cooled by the IDEC subsystem 12. The IDEC subsystem 12 will either economize or take advantage of free heat in the outdoor ambient air to provide passive heating.

A fourth exemplary mode of operation is shown in FIG. 9, wherein the hybrid system 10 provides IDEC cooling. In this mode of operation, fresh air cooling is provided by the IDEC subsystem 12 in isolation using fresh (outside, or non-recirculated) air. In some embodiments, 100% fresh outdoor air is supplied. The IDEC subsystem 12 is in an "on" condition to operate independently and alone, with the heat pump subsystem 16 being in an "off" condition. Fresh air enters the IDEC subsystem 12 as intake air from the environment surrounding the hybrid system 10, is cooled by the IDEC module 36, and then supplied to the room as cooled supply air. A portion of the intake air that has been heated by heat exchange within the IDEC module 36 may be vented to the environment as exhaust air, such as through the outlet 58. In some embodiments, the first supply fan 42A and the exhaust fan 44 are activated, and the first backdraft damper 60A is open.

Figure 10:
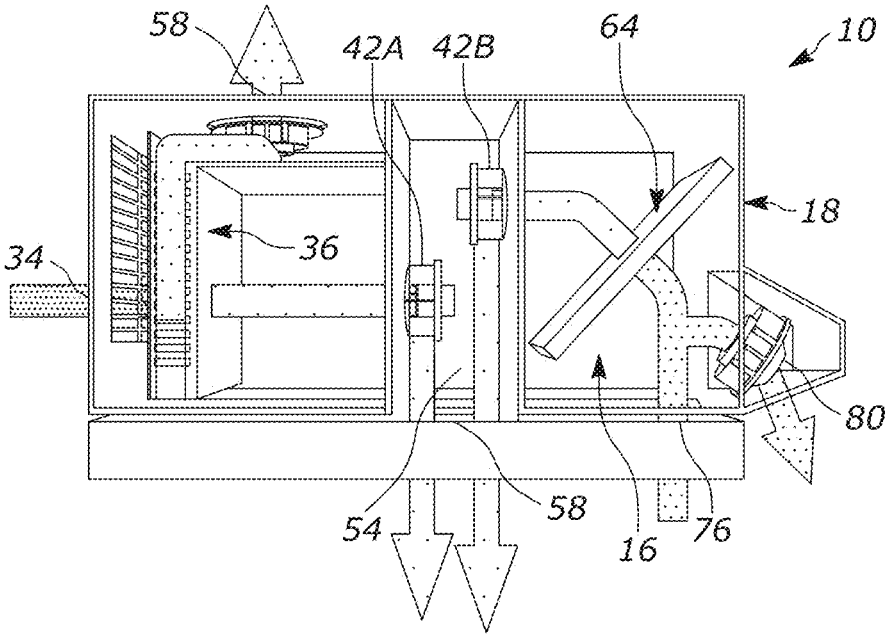
FIG. 10 shows a simplified side view of a hybrid heating and cooling system in an exemplary fifth mode of operation, with airflow indicated by arrows, in accordance with the present disclosure.

A fifth exemplary mode of operation is shown in FIG. 10, wherein the hybrid system 10 provides hybrid cooling. In this mode of operation, cooling is provided by both the IDEC subsystem 12 and the heat pump subsystem 16. In this mode of operation, the heat pump subsystem 16 is in the "on" condition. Return air enters the heat pump subsystem 16 from a room, such as through inlet 76, and is cooled by the heat pump subsystem 16 and provided back to the room as supply air. Additionally, in this mode of operation the IDEC subsystem 12 is also in the "on" condition so both the IDEC subsystem 12 and the heat pump subsystem 16 operate in parallel to provide a mixture of fresh air and recirculated air to the room. Fresh (outside, or non-recirculated) air enters the IDEC subsystem 12 from the environment surrounding the hybrid system 10 and is cooled as shown and described in FIG. 9. Cooled air from the IDEC subsystem 12 and cooled air from the heat pump subsystem 16 are mixed within the mixing plenum 54 and together supplied to the room. In some embodiments, the first supply fan 42A and the exhaust fan 44 are activated, and the first backdraft damper 60A is open. Further, in some embodiments, the second supply fan 42B, the condenser fan 72, and the compressor subsystem 56 are activated, and the second backdraft damper 60B is open.

Figure 11:
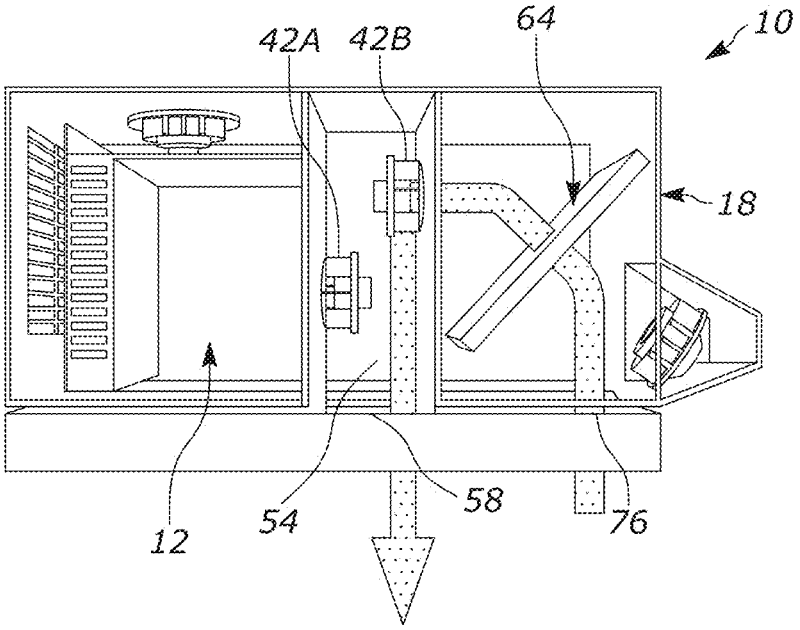
FIG. 11 shows a simplified side view of a hybrid heating and cooling system in an exemplary sixth mode of operation, with airflow indicated by arrows, in accordance with the present disclosure.

A sixth exemplary mode of operation is shown in FIG. 11, wherein the hybrid system 10 provides recirculation cooling. In this mode of operation, recirculation cooling is provided by the heat pump subsystem 16 using the low stage of the compressor of the compressor subsystem 56 in isolation, with no fresh air entering the IDEC subsystem 12 and supplied as ambient supply air. That is, the heat pump subsystem 16 is in an "on" condition to operate independently and alone, with the IDEC subsystem 12 being in an "off" condition. Return air enters the heat pump subsystem 16 from the room and cooled air is supplied back to the room from the heat pump subsystem 16. In one embodiment, no air exits the heat pump subsystem as exhaust air. Further, in some embodiments, the second supply fan 42B, the condenser fan 72, and the compressor subsystem 56 are activated, and the second backdraft damper 60B is open.

EMBODIMENTS

In one embodiment, a hybrid heating and cooling system comprises: an indirect-direct evaporative cooler (IDEC) subsystem; a heat pump subsystem; and a mixing plenum located between and in fluid communication with the IDEC subsystem and the heat pump subsystem, the mixing plenum being configured to mix a flow of fluid from the IDEC subsystem and a flow of fluid from the heat pump subsystem, the IDEC subsystem and the heat pump subsystem being independently operable.

In one aspect of the embodiment, the system further comprises a first supply fan in the mixing plenum and a second supply fan in the plenum. In one aspect of the embodiment, the first supply fan is in fluid communication with the IDEC subsystem; and the second supply fan is in fluid communication with the heat pump subsystem. In one aspect of the embodiment, each of the first supply fan and the second supply fan includes a backdraft damper.

In one aspect of the embodiment, the IDEC subsystem includes an IDEC module, the IDEC module including: at least one compact indirect evaporative cooler; and at least one direct evaporative medium. In one aspect of the embodiment, the IDEC module further includes an exhaust fan, the at least one compact indirect evaporative cooler being a plurality of compact indirect evaporative coolers, the plurality of compact indirect evaporative coolers being arranged radially around the exhaust fan.

In one aspect of the embodiment, the system further comprises a control unit, the control unit including processing circuitry that is programmable to execute operational logic to operate the system in any of a plurality of modes of operation. In one aspect of the embodiment, the processing circuitry is programmed to execute operational logic to selectively operate the system in a plurality of modes of operation, the plurality of modes of operation including:

- a first mode of operation in which the system provides recirculation heating, wherein the IDEC subsystem is in an off condition and the heat pump subsystem is in an on condition, return air entering the heat pump subsystem, being heated within the heat pump subsystem, and then being provided as heated supply air;
- a second mode of operation in which the system provides heating with non-recirculated air, wherein the IDEC subsystem is in an on condition and the heat pump subsystem is in an on condition, non-recirculated air entering the IDEC subsystem and then being provided as ambient supply air, and return air entering the heat pump subsystem, being heated within the heat pump subsystem, and then being provided as heated supply air;
- a third mode of operation in which the system provides passive heating and/or cooling, wherein the IDEC subsystem is in an on condition and the heat pump subsystem is in an off condition, non-recirculated air entering the IDEC subsystem and then being provided as ambient supply air;
- a fourth mode of operation in which the system provides IDEC cooling, wherein the IDEC subsystem is in an on condition and the heat pump subsystem is in an off condition, non-recirculated air entering the IDEC subsystem, being cooled within the IDEC subsystem, and then being provided as cooled supply air;
- a fifth mode of operation in which the system provides hybrid cooling, wherein the IDEC subsystem is in an on condition and the heat pump subsystem is in an on condition, non-recirculated air entering the IDEC subsystem, being cooled by the IDEC subsystem, then being supplied and cooled return air, and return air entering the heat pump subsystem, being cooled within the heat pump subsystem, and being provided as cooled supply air; and a sixth mode of operation in which the system provides recirculation cooling, wherein the IDEC subsystem is in an off condition and the heat pump subsystem is in an on condition, return air entering the heat pump subsystem, being cooled within the heat pump subsystem, and then being provided as cooled supply air.

In one embodiment, a method of providing heating and/or cooling to a room comprises: operating a hybrid heating and cooling system in any of a plurality of modes of operation, the hybrid heating and cooling system including: an indirect-direct evaporative cooler (IDEC) subsystem; a heat pump subsystem; and a mixing plenum located between and in fluid communication with the IDEC subsystem and the heat pump subsystem, the mixing plenum being configured to mix a flow of fluid from the IDEC subsystem and a flow of fluid from the heat pump subsystem, the IDEC subsystem and the heat pump subsystem being independently operable.

In one aspect of the embodiment, operating the hybrid heating and cooling system in any of the plurality of modes of operation includes at least one of:

a. providing recirculation heating to the room by drawing return air from the room into the D heat pump X subsystem, heating the return air with the heat pump subsystem, and then returning the heated return air to the room as heated supply air, no air being drawn into the IDEC subsystem;

b. providing heating with non-recirculated air to the room by:

drawing return air from the room into the heat pump subsystem, heating the return air with the heat pump subsystem, and then returning the heated return air to the room as heated supply air; and drawing non-recirculated air into the IDEC subsystem and then providing the non-recirculated air to the room as ambient supply air, the ambient supply air from the IDEC subsystem and the heated supply air from the heat pump subsystem being mixed in the mixing plenum before being delivered to the room;

c. providing passive heating and/or cooling to the room by drawing non-recirculated air into the IDEC subsystem and then providing the non-recirculated air to the room as ambient supply air, no air being drawn into the heat pump subsystem;

d. providing IDEC cooling to the room by drawing non-recirculated air into the IDEC subsystem, cooling the non-recirculated air with the IDEC subsystem, and then providing the cooled non-recirculated air to the room as cooled supply air, no air being drawn into the heat pump subsystem;

e. providing hybrid cooling to the room by:

drawing return air from the room into the heat pump subsystem, cooling the return air with the heat pump subsystem, and then returning the cooled return air to the room as cooled supply air; and drawing non-recirculated air into the IDEC subsystem, cooling the non-recirculated air with the IDEC subsystem, and then providing the cooled non-recirculated air to the room as cooled supply air, the cooled supply air from the IDEC subsystem and the cooled supply air from the heat pump subsystem being mixed in the mixing plenum before being delivered to the room; and f. providing recirculation cooling to the room by drawing return air into the heat pump subsystem, cooling the return air with the heat pump subsystem, and then returning the cooled return air to the room as cooled supply air, no air being drawn into the IDEC subsystem.

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention.

What is claimed is:

1. A hybrid heating and cooling system, the system comprising:

an indirect-direct evaporative cooler (IDEC) subsystem;

a heat pump subsystem; and a mixing plenum located between and in fluid communication with the IDEC subsystem and the heat pump subsystem, the mixing plenum being configured to mix a flow of fluid from the IDEC subsystem and a flow of fluid from the heat pump subsystem, the IDEC subsystem and the heat pump subsystem being independently operable and operable in parallel.

2. The hybrid heating and cooling system of claim 1, wherein the hybrid heating and cooling system provides between approximately 5 tons and approximately 6 tons of cooling capacity and has an installation footprint of approximately 88 inches in length, approximately 54 inches in width, and approximately 45 inches in height.

3. The hybrid heating and cooling system of claim 1, further comprising a first supply fan in the mixing plenum and a second supply fan in the plenum.

4. The hybrid heating and cooling system of claim 3, wherein:

the first supply fan is in fluid communication with the IDEC subsystem; and the second supply fan is in fluid communication with the heat pump subsystem.

5. The hybrid heating and cooling system of claim 4, wherein each of the first supply fan and the second supply fan includes a backdraft damper.

6. The hybrid heating and cooling system of claim 5, wherein each backdraft damper is a passively actuated backdraft damper.

7. The hybrid heating and cooling system of claim 1, wherein the IDEC subsystem includes an IDEC module, the IDEC module including:

at least one compact indirect evaporative cooler; and at least one direct evaporative medium.

8. The hybrid heating and cooling system of claim 7, wherein the IDEC module further includes an exhaust fan, the at least one compact indirect evaporative cooler being a plurality of compact indirect evaporative coolers.

9. The hybrid heating and cooling system of claim 8, wherein the plurality of compact indirect evaporative coolers are arranged radially around the exhaust fan.

10. The hybrid heating and cooling system of claim 1, wherein the heat pump subsystem includes an evaporator subsystem and a condenser subsystem.

11. The hybrid heating and cooling system of claim 1, the system further comprising a control unit, the control unit including processing circuitry that is programmable to execute operational logic to operate the system in any of a plurality of modes of operation.

12. The hybrid heating and cooling system of claim 11, wherein the processing circuitry is programmed to execute operational logic to selectively operate the system in a plurality of modes of operation, the plurality of modes of operation including:

a first mode of operation in which the system provides recirculation heating, wherein the IDEC subsystem is in an off condition and the heat pump subsystem is in an on condition, return air entering the heat pump subsystem, being heated within the heat pump subsystem, and then being provided as heated supply air;

a second mode of operation in which the system provides heating with non-recirculated air, wherein the IDEC subsystem is in an on condition and the heat pump subsystem is in an on condition, non-recirculated air entering the IDEC subsystem and then being provided as ambient supply air, and return air entering the heat pump subsystem, being heated within the heat pump subsystem, and then being provided as heated supply air;

a third mode of operation in which the system provides passive heating and/or cooling, wherein the IDEC subsystem is in an on condition and the heat pump subsystem is in an off condition, non-recirculated air entering the IDEC subsystem and then being provided as ambient supply air;

a fourth mode of operation in which the system provides IDEC cooling, wherein the IDEC subsystem is in an on condition and the heat pump subsystem is in an off condition, non-recirculated air entering the IDEC subsystem, being cooled within the IDEC subsystem, and then being provided as cooled supply air;

a fifth mode of operation in which the system provides hybrid cooling, wherein the IDEC subsystem is in an on condition and the heat pump subsystem is in an on condition, non-recirculated air entering the IDEC subsystem, being cooled by the IDEC subsystem, then being supplied and cooled return air, and return air entering the heat pump subsystem, being cooled within the heat pump subsystem, and being provided as cooled supply air; and a sixth mode of operation in which the system provides recirculation cooling, wherein the IDEC subsystem is in an off condition and the heat pump subsystem is in an on condition, return air entering the heat pump subsystem, being cooled within the heat pump subsystem, and then being provided as cooled supply air.

13. A method of providing heating and/or cooling to a room, the method comprising:

operating a hybrid heating and cooling system in any of a plurality of modes of operation, the hybrid heating and cooling system including:

an indirect-direct evaporative cooler (IDEC) subsystem;

a heat pump subsystem; and a mixing plenum located between and in fluid communication with the IDEC subsystem and the heat pump subsystem, the mixing plenum being configured to mix a flow of fluid from the IDEC subsystem and a flow of fluid from the heat pump subsystem, the IDEC subsystem and the heat pump subsystem being independently operable.

14. The method of claim 13, wherein operating the hybrid heating and cooling system in any of the plurality of modes of operation includes providing recirculation heating to the room by drawing return air from the room into the heat pump subsystem, heating the return air with the heat pump subsystem, and then returning the heated return air to the room as heated supply air, no air being drawn into the IDEC subsystem.

15. The method of claim 13, wherein operating the hybrid heating and cooling system in any of the plurality of modes of operation includes providing heating with non-recirculated air to the room by:

drawing return air from the room into the heat pump subsystem, heating the return air with the heat pump subsystem, and then returning the heated return air to the room as heated supply air; and drawing non-recirculated air into the IDEC subsystem and then providing the non-recirculated air to the room as ambient supply air, the ambient supply air from the IDEC subsystem and the heated supply air from the heat pump subsystem being mixed in the mixing plenum before being delivered to the room.

16. The method of claim 13, wherein operating the hybrid heating and cooling system in any of the plurality of modes of operation includes providing passive heating and/or cooling to the room by drawing non-recirculated air into the IDEC subsystem and then providing the non-recirculated air to the room as ambient supply air, no air being drawn into the heat pump subsystem.

17. The method of claim 13, wherein operating the hybrid heating and cooling system in any of the plurality of modes of operation includes providing IDEC cooling to the room by drawing non-recirculated air into the IDEC subsystem, cooling the non-recirculated air with the IDEC subsystem, and then providing the cooled non-recirculated air to the room as cooled supply air, no air being drawn into the heat pump subsystem.

18. The method of claim 13, wherein operating the hybrid heating and cooling system in any of the plurality of modes of operation includes providing hybrid cooling to the room by:

drawing return air from the room into the heat pump subsystem, cooling the return air with the heat pump subsystem, and then returning the cooled return air to the room as cooled supply air; and drawing non-recirculated air into the IDEC subsystem, cooling the non-recirculated air with the IDEC subsystem, and then providing the cooled non-recirculated air to the room as cooled supply air, the cooled supply air from the IDEC subsystem and the cooled supply air from the heat pump subsystem being mixed in the mixing plenum before being delivered to the room.

19. The method of claim 13, wherein operating the hybrid heating and cooling system in any of the plurality of modes of operation includes providing recirculation cooling to the room by drawing return air into the heat pump subsystem, cooling the return air with the heat pump subsystem, and then returning the cooled return air to the room as cooled supply air, no air being drawn into the IDEC subsystem.

* * * * *